US007148848B2

(12) United States Patent
Colburn et al.

(10) Patent No.: US 7,148,848 B2
(45) Date of Patent: Dec. 12, 2006

(54) DUAL BAND, BENT MONOPOLE ANTENNA

(75) Inventors: Joseph S Colburn, Pacific Palisades, CA (US); Adesunloye Obatoyinbo, Cambridge, MA (US); Jonathan J Lynch, Oxnard, CA (US)

(73) Assignee: General Motors Corporation, Detroit, MI (US)

( * ) Notice: Subject to any disclaimer, the term of this patent is extended or adjusted under 35 U.S.C. 154(b) by 72 days.

(21) Appl. No.: 10/974,303

(22) Filed: Oct. 27, 2004

(65) Prior Publication Data

US 2006/0097935 A1 May 11, 2006

(51) Int. Cl.
*H01Q 1/38* (2006.01)
*H01Q 21/08* (2006.01)

(52) U.S. Cl. ..... 343/700 MS; 343/810

(58) Field of Classification Search ..... 343/700 MS, 343/795, 746, 767, 810
See application file for complete search history.

(56) References Cited

U.S. PATENT DOCUMENTS 5,481,272 A * 1/1996 Yarsunas ..... 343/797
6,025,812 A * 2/2000 Gabriel et al. ..... 343/797
6,333,720 B1 * 12/2001 Gottl et al. ..... 343/810
6,344,833 B1 * 2/2002 Lin et al. ..... 343/846
6,593,900 B1 * 7/2003 Craven et al. ..... 343/895
6,670,925 B1 * 12/2003 Iwai et al. ..... 343/702
6,930,650 B1 * 8/2005 Gottl ..... 343/810

OTHER PUBLICATIONS

E. Lee, P.S. Hall and P. Gardner, "Compact wideband planar monopole antenna", Electronics Letters, vol. 35, No. 25, Dec. 1999, p. 2157-2158.
J.M. Johnson and Y. Rahmat-Samii, The Tab Monopole, IEEE Transactions on Antenna and Propagation, vol. 45, No. 1, Jan. 1997, p. 187-188.
N.P. Agrawall, G. Kumar and K.P. Ray, "Wide-Band Planar Momopole Antennas", IEEE Transactions On Antennas and Propagation, vol. 46, No. 2, Feb. 1998, p. 294-295.

* cited by examiner

*Primary Examiner*—Trinh Dinh
*Assistant Examiner*—Huedung Mancuso
(74) *Attorney, Agent, or Firm*—Kathryn A. Marra

(57) ABSTRACT

A dual-band monopole antenna includes a ground plane. A metal plate is located a first distance from the ground plane and includes first and second portions connecting to form a first angle therebetween. A slot is formed in the metal plate that isolates a center portion of the metal plate. The dual-band monopole antenna communicates first radio frequency (RF) signals in a first RF band and second RF signals in a second RF band. A feed tab contacts an outer surface of the metal plate and is located the first distance from the ground plane. The first RF signals and the second RF signals are vertical polarized signals. The dual-band monopole antenna produces a radiation pattern that is omnidirectional in the azimuth plane and vertically polarized in a horizontal plane. The first RF band and the second RF band are independently tuned.

36 Claims, 4 Drawing Sheets

DUAL BAND, BENT MONOPOLE ANTENNA

FIELD OF THE INVENTION

The present invention relates to monopole antennas, and more particularly to dual-band monopole antennas.

BACKGROUND OF THE INVENTION

Various vehicle systems may require an antenna for mobile phones, satellite radio, terrestrial radio, and/or global positioning systems. Providing several antennas on a vehicle is costly and aesthetically displeasing. The antennas are preferably low profile and small in size.

Terrestrial communications systems require the transmission and/or reception of vertical polarized signals. Terrestrial communications systems may require reception and transmission of radio frequency (RF) signals in multiple bands. For example, vehicle systems such as mobile phones and remote assistance services transmit and/or receive vertical polarized signals in multiple bands.

Mobile phone and remote assistance services typically require communication in both the Advanced Mobile Phone System (AMPS) and the Personal Communications Services (PCS) bands. A dual band antenna that communicates in both the AMPS (824 to 894 MHz) and PCS (1.85 to 1.99 GHz) bands requires a large frequency separation. In one method, a patch antenna is used for dual band communications. However, a patch antenna transmits/receives most of its energy perpendicular to the plane of the patch antenna, which is not suitable for terrestrial communications.

In another method, a planar monopole antenna provides dual-band terrestrial communications. Monopole antennas operate due to multiple reflections between the ends of the antenna and a feed point, which creates a resonance. However, higher-order resonant frequencies of monopole antennas are typically fixed relative to the fundamental resonance. Therefore, planar monopole antennas cannot typically operate in both the AMPS and PCS bands.

SUMMARY OF THE INVENTION

A dual-band monopole antenna according to the present invention includes a ground plane. A metal plate is located a first distance from the ground plane and includes first and second portions connecting to form a first angle therebetween. A slot is formed in the metal plate that isolates a center portion of the metal plate. The dual-band monopole antenna communicates first radio frequency (RF) signals in a first RF band and second RF signals in a second RF band.

In other features, a feed tab contacts an outer surface of the metal plate between the metal plate and the ground plane and is located the first distance from the ground plane. The first and second portions of the metal plate are planar. A width of the slot determines a higher-order resonant frequency of the dual-band monopole antenna. The slot is offset a second distance from a perimeter of the metal plate towards a center of the metal plate. The second distance determines a higher-order resonant frequency of the dual-band monopole antenna. The metal plate is rectangular. The first and second portions of the metal plate both extend a second distance from a center of the metal plate. The first angle is equal to one of 60, 90, 120, or 180 degrees.

In still other features of the invention, the first RF signals and the second RF signals are vertical polarized signals. The dual-band monopole antenna produces a radiation pattern that is omnidirectional in the azimuth plane and vertically polarized in a horizontal plane when communicating the first RF signals and the second RF signals. The first RF band and the second RF band are independently tuned. The first RF band is an Advanced Mobile Phone System (AMPS) band. The second RF band is a Personal Communications Services (PCS) band. The dual-band monopole antenna is fed by a cable with a first conductor and a second conductor. The first conductor connects to one of the first portion or the second portion of the metal plate and the second conductor connects to the ground plane.

In yet other features, the dual-band monopole antenna is fed by a cable with a first conductor and a second conductor. The first conductor connects to the feed tab and the second conductor connects to the ground plane. The cable excites the metal plate with respect to the ground plane to transmit vertical polarized signals. The dual-band monopole antenna operates in a mobile phone system. The dual-band monopole antenna is contained in a housing. The housing is mounted behind a rearview mirror of a vehicle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 2:
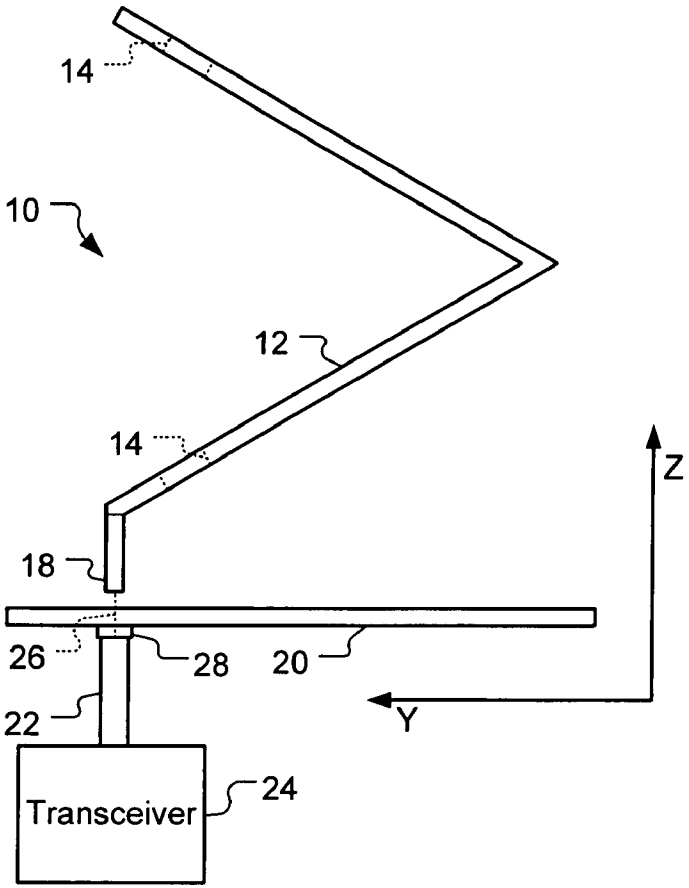
FIG. 2 is a profile view of the antenna in FIG. 1.

The following description of the preferred embodiment(s) is merely exemplary in nature and is in no way intended to limit the invention, its application, or uses. For purposes of clarity, the same reference numbers will be used in the drawings to identify similar elements.

Figure 1:
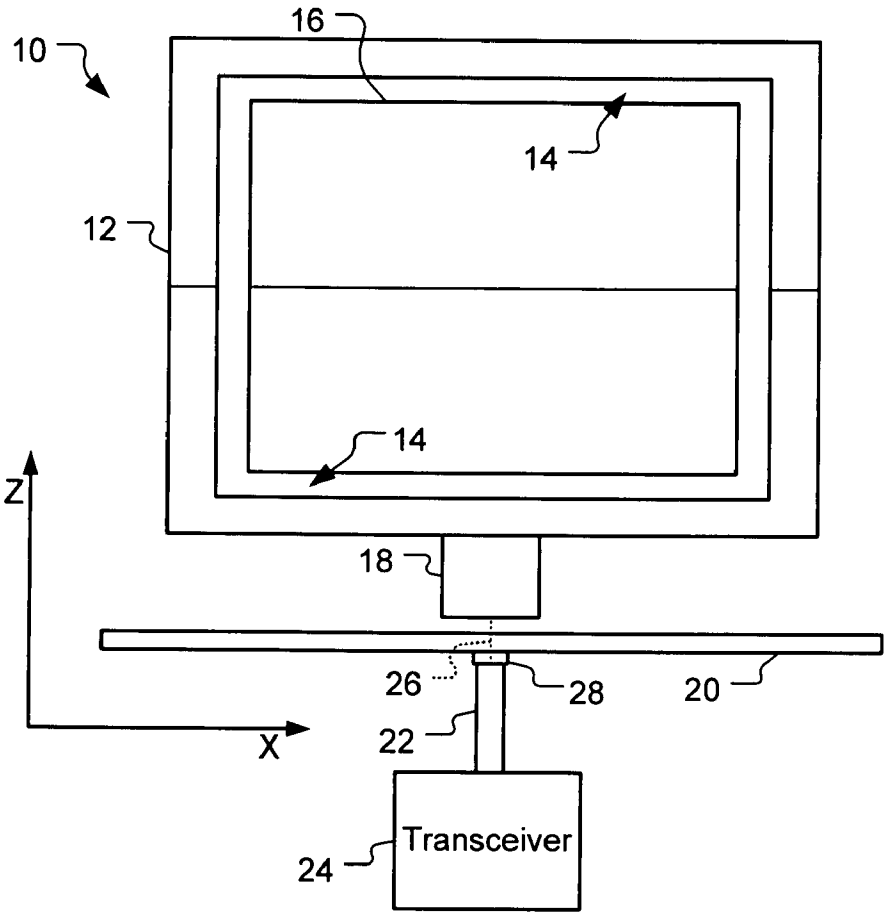
FIG. 1 is front view of a dual-band monopole antenna according to the present invention.

Referring to FIGS. 1 and 2, an antenna 10 includes a metal plate 12 that is bent a first number of degrees. In other words, the metal plate 12 includes first and second portions that connect to form a first angle therebetween. In an exemplary embodiment, the metal plate 12 is rectangular in shape and bent symmetrically about the center of the metal plate 12. For example, the angle between the first and second portions of the metal plate 12 may be 60, 90, 120, 180, or another number of degrees. A slot 14 is formed in the metal plate 12 that isolates a center portion 16 of the metal plate 12. In an exemplary embodiment, the slot 14 has a first width and is offset a first distance from the perimeter of the metal plate 12 towards the center of the metal plate 12.

Since the center portion 16 of the metal plate 12 does not contact the rest of the metal plate 12, the metal plate 12 is preferably mounted on conductive tape before the slot 14 is formed. The conductive tape may then be mounted on a non-conducting substrate so that the center portion 16 and the rest of the metal plate 12 remain fixed in place. A first end of a feed tab 18 contacts an outer edge of the metal plate 12. A second end of the feed tab 18 is located a first distance from a ground plane 20. While the antenna 10 illustrated in FIGS. 1 and 2 includes the feed tab 18, the antenna may function as desired without the feed tab 18. Additionally, when the metal plate 12 is mounted on a non-conducting substrate, the non-conducting substrate preferable contacts the feed tab 18 and the ground plane 20 so that all of the components of the antenna 10 remain fixed in place.

Before the slot 14 is formed in the metal plate 12 and before the metal plate 12 is bent, the metal plate 12 resembles a planar monopole antenna. The fundamental resonant frequency of a planar monopole antenna is equal to a value for which the length of the radiating element is approximately one-quarter of a wavelength. Planar monopole antennas have higher-order resonant frequencies that are typically fixed relative to the fundamental resonant frequency. Higher-order resonant frequencies occur at frequencies for which the radiating element is approximately any higher odd number of one-quarter wavelengths (or according to $$\left((2n+1)\frac{\lambda}{2}\right),\ n=1,2,3,\ldots,$$

where $\lambda$ is the wavelength).

By adding the closed slot 14 to the antenna 10, the frequency at which a higher-order resonant frequency occurs is lowered. Additionally, a more desirable impedance match to a 50 Ω feed cable is achieved. While the higher-order resonant frequency may be lowered, the frequency at which the fundamental resonant frequency occurs remains relatively unchanged. Therefore, the fundamental and higher-order resonant frequencies may be independently tuned. For example, the width of the slot 14 and/or the distance that the slot 14 is offset towards the center of the metal plate 12 may be adjusted to change the higher-order resonant frequency.

The metal plate 12 is bent to reduce the overall height of the dual-band monopole antenna 10. The reduction in the height of the antenna 10 is achieved without increasing cross-polarization radiation. The antenna 10 is fed by a feed cable 22 that connects to a transceiver 24. The feed cable 22 includes first and second conductors 26 and 28, respectively. For example, the feed cable 22 may be a coaxial cable. The first conductor 26 is connected to the feed tab 18, and the second conductor 28 is connected to the ground plane 20. The feed cable 22 excites the metal plate 12 with respect to the ground plane 20 to transmit/receive radio frequency (RF) signals. In the even that the antenna 10 does not include the feed tab 18, the first conductor connects to an outer surface of the metal plate 12.

The antenna 10 transmits/receives vertical polarized signals at both the fundamental and the higher-order resonant frequencies. Therefore, the antenna 10 is particularly applicable to mobile phone and remote assistance services that typically require communications in both the Advanced Mobile Phone System (AMPS) (824–894 MHz) and the Personal Communications Services (PCS) (1.85–1.99 GHz) bands. The radiation pattern of the antenna 10 is symmetric about and polarized parallel to a vertical axis of the antenna 10 at both resonant frequencies.

The radiation pattern at both resonant frequencies is also omnidirectional and maximum in the azimuth plane, which is perpendicular to the vertical axis of the antenna 10. It is possible to operate the dual-band monopole antenna 10 without the center portion 16 of the metal plate 12. However, capacitive coupling between the center portion 16 and the rest of the metal plate 12 provides an additional degree of freedom in the design of the antenna 10.

Figure 3:
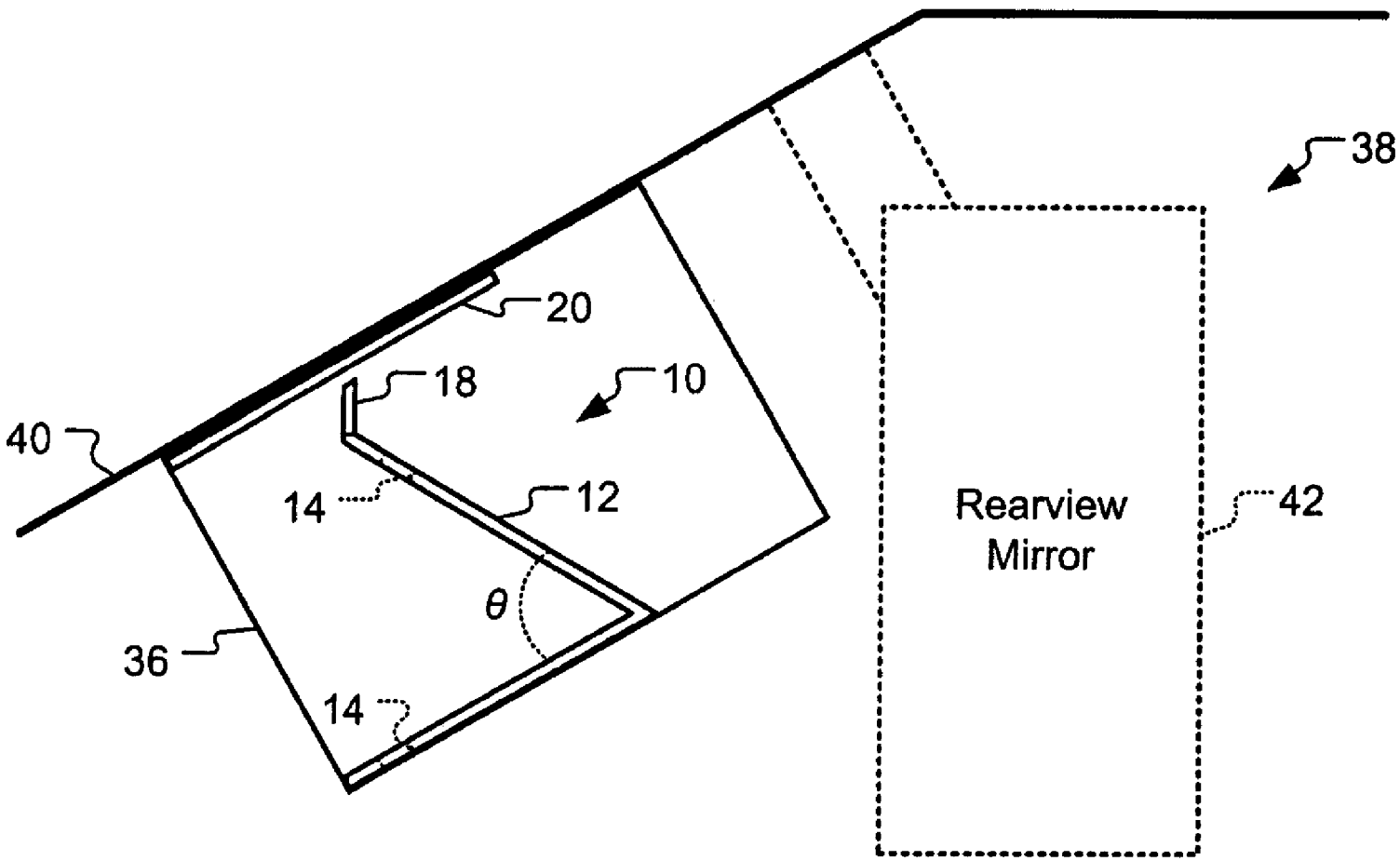
FIG. 3 is a cross-sectional view of the antenna in FIG. 1 contained in a housing and mounted in a vehicle.

Referring now to FIG. 3, the dual-band monopole antenna 10 is contained within a housing 36. The ground plane 20 is oriented at an appropriate angle so that the antenna 10 fits inside of a housing 36 that is rectangular in shape. The antenna 10 illustrated in FIG. 3 is bent so that the inner angle (θ) of the metal plate 12 is equal to 60 degrees. However, the inner angle (θ) of the metal plate 12 may be set at different angles to accommodate particular applications or housings 36. In an exemplary embodiment, the housing 36 is mounted in a vehicle 38 for mobile phone and/or remote assistance services. For example, in FIG. 3, the housing 36 is mounted on a windshield 40 and behind a rearview mirror 42 of a vehicle 38. An exemplary prototype antenna 10 according to the present invention protrudes less than 1 inch from the windshield 40 and occupies an area less than 5 inches by 3 inches on the windshield 40.

Figure 4:
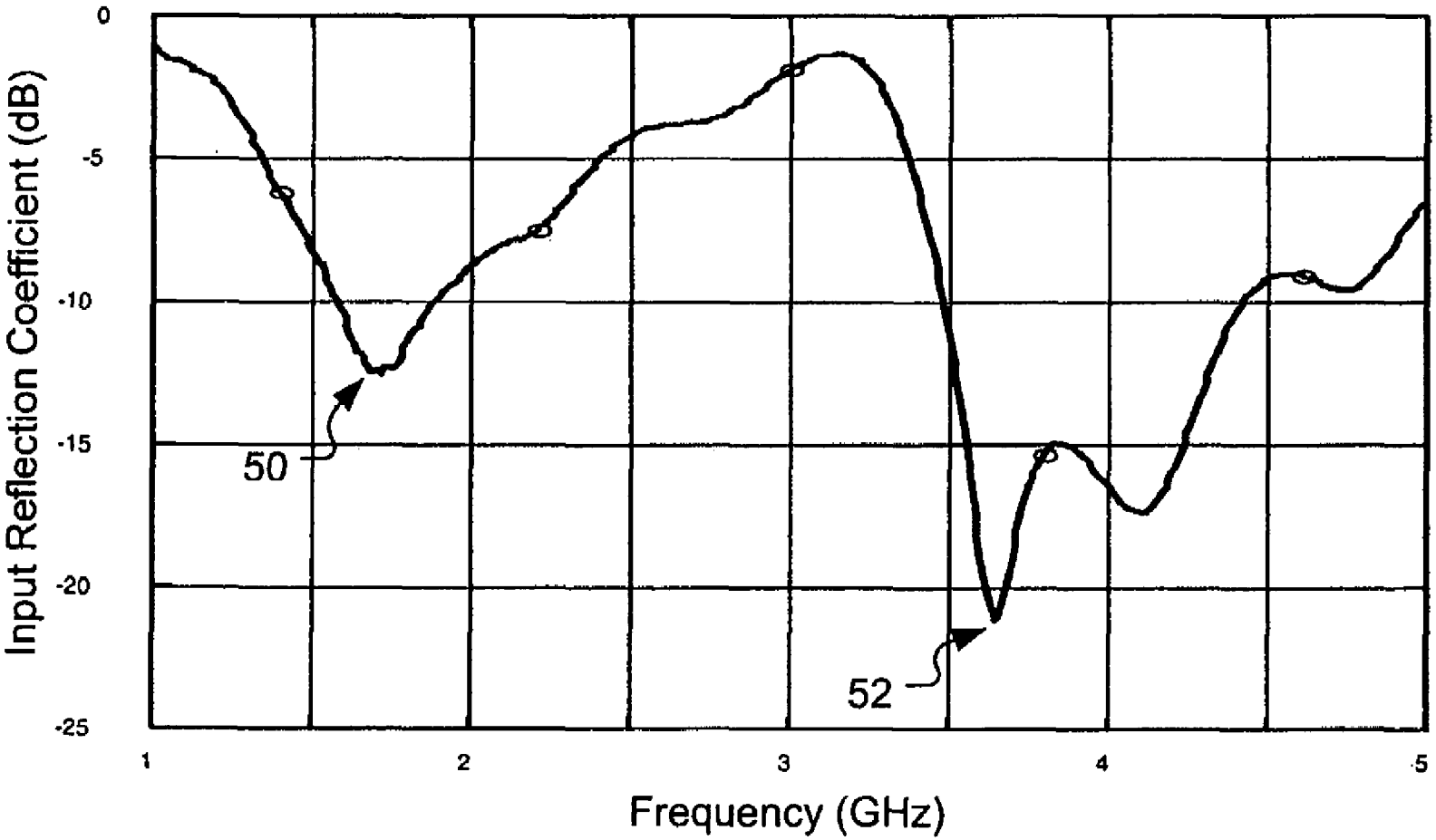
FIG. 4 is a graph showing the input reflection coefficient of the antenna as a function of frequency.

Referring now to FIG. 4, the resonant frequencies of an exemplary antenna 10 according to the present invention are illustrated. The exemplary antenna 10 from which the impedance match illustrated in FIG. 4 was obtained is a prototype constructed at half-scale. Therefore, the equivalent frequency bands of interest are 1648–1788 MHz for the AMPS band and 3700–3940 for the PCS band. FIG. 4 illustrates two distinct resonances. The first resonant frequency, indicated by 50, occurs at approximately 1750 MHz, which is ideal for communications in the AMPS band. The second resonant frequency, indicated by 52, occurs at approximately 3700 MHz, which is ideal for communications in the PCS band.

Figure 5B:
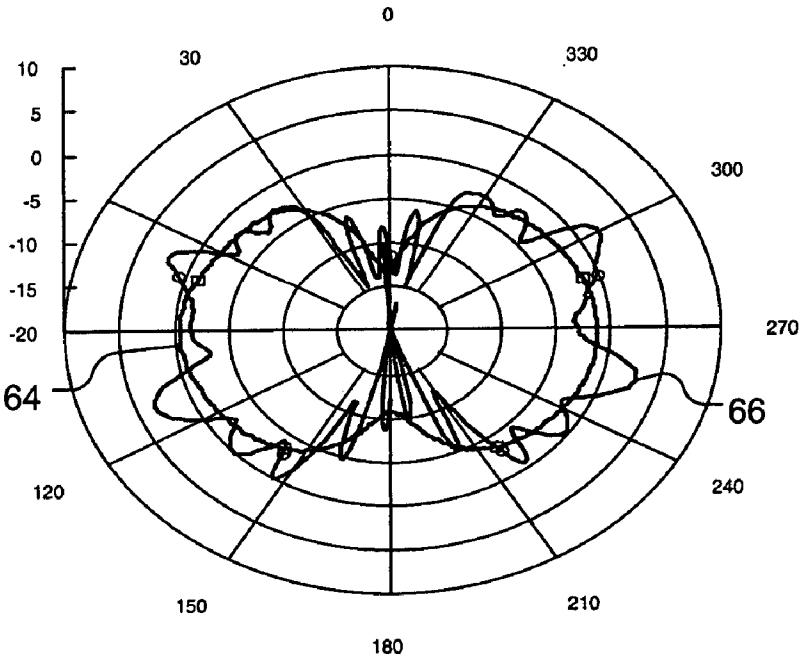
FIG. 5B is a plot illustrating the radiation pattern of the antenna in the azimuth plane while communicating in the PCS band.
Figure 5A:
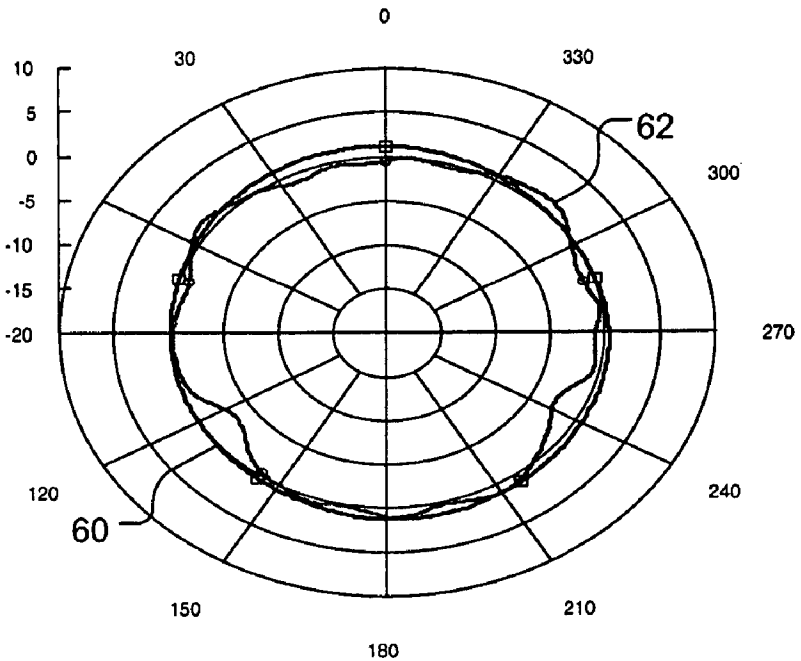
FIG. 5A is a plot illustrating the radiation pattern of the antenna in the azimuth plane while communicating in the AMPS band.

Referring now to FIGS. 5A and 5B, the measured gain of the exemplary antenna 10 according to the present invention is shown in the AMPS band (FIG. 5A) and in the PCS band (FIG. 5B). The measured gain is shown in the azimuth plane, which is perpendicular to the vertical axis of the antenna 10. In FIG. 5A, a first radiation pattern, indicated by 60, illustrates the gain of the antenna 10 alone. A second radiation pattern, indicated by 62, illustrates the gain of the antenna 10 while mounted in scaled model of a vehicle. Both radiation patterns are substantially omnidirectional in the azimuth plane.

In FIG. 5B, a first radiation pattern, illustrated at 64, illustrates the gain of the antenna 10 alone while communicating in the AMPS band. A second radiation pattern, indicated by 66, illustrates the gain of the antenna 10 while mounted in the scaled model of a vehicle and while communicating in the PCS band. While the radiation patterns in FIG. 5B are not completely omnidirectional, the radiation patterns are sufficient for desirable communications in the PCS band.

The dual-band monopole antenna 10 according to the present invention provides omnidirectional vertical polarization coverage in the azimuth plane in both the AMPS and PCS bands. The antenna 10 is ideal for terrestrial communications systems that cover both the AMPS and PCS bands. For example, the antenna 10 is particularly applicable to commercial vehicle communications systems. Forming the closed slot 14 in the antenna 10 limits current paths in the metal plate 12 and allows for control over the ratio between the fundamental and higher-order resonant frequencies. Additionally, bending the antenna 10 reduces the overall height of the antenna 10 while suppressing cross-polarization radiation.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A dual-band monopole antenna, comprising:

a ground plane; and an antenna assembly comprising:

a first metal plate that includes a central opening and that is bent at a first angle at a center portion thereof to form first and second portions;

a second metal plate that is bent at said first angle at a center portion thereof to form first and second portions; and a substrate that mounts said second metal plate spaced from and within said central opening to form a slot between said first metal plate and said second metal plate, wherein said first portions of said first and second metal plates are substantially co-planar and said second portions of said first and second metal plates are substantially co-planar, wherein said assembly is located a first distance from said ground plane; and wherein said dual-band monopole antenna communicates first radio frequency (RF) signals in a first RF band and second RF signals in a second RF band.

2. The dual-band monopole antenna of claim 1 further comprising:

a feed tab that contacts an outer surface of said first metal plate between said first metal plate and said ground plane and that is located said first distance from said ground plane.

3. The dual-band monopole antenna of claim 1 wherein a width of said slot determines a higher-order resonant frequency of said dual-band monopole antenna.

4. The dual-band monopole antenna of claim 1 wherein said first metal plate and said second metal plate are rectangular.

5. The dual-band monopole antenna of claim 1 wherein said first metal plate extends a second distance from a center of said first metal plate and said second metal plate extends a third distance from a center of said second metal plate.

6. The dual-band monopole antenna of claim 1 wherein said first angle is equal to one of 60, 90,120, or 180 degrees.

7. The dual-band monopole antenna of claim 1 wherein said first RF signals and said second RF signals are vertical polarized signals.

8. The dual-band monopole antenna of claim 1 wherein said dual-band monopole antenna produces a radiation pattern that is omnidirectional in the azimuth plane and vertically polarized in a horizontal plane when communicating said first RF signals and said second RF signals.

9. The dual-band monopole antenna of claim 1 wherein said first RF band and said second RF band are independently tuned.

10. The dual-band monopole antenna of claim 1 wherein said first RF band is an Advanced Mobile Phone System (AMPS) band.

11. The dual-band monopole antenna of claim 1 wherein said first RF band is a Personal Communications Services (PCS) band.

12. The dual-band monopole antenna of claim 1 wherein said dual-band monopole antenna is fed by a cable with a first conductor and a second conductor and wherein said first conductor connects to said first metal plate and said second conductor connects to said ground plane.

13. The dual-band monopole antenna of claim 2 wherein said dual-band monopole antenna is fed by a cable with a first conductor and a second conductor and wherein said first conductor connects to said feed tab and said second conductor connects to said ground plane.

14. The dual-band monopole antenna of claim 12 wherein said cable excites said first metal plate with respect to said ground plane to transmit vertical polarized signals.

15. The dual-band monopole antenna of claim 1 wherein said dual-band monopole antenna operates in a mobile phone system.

16. The dual-band monopole antenna of claim 1 wherein said dual-band monopole antenna is contained in a housing.

17. The dual-band monopole antenna of claim 15 wherein said housing is mounted behind a rearview mirror of a vehicle.

18. A dual-band monopole antenna, comprising:

a ground plane; and a metal plate that is located a first distance from said ground plane and that includes first and second portions connecting to form a first angle therebetween, wherein a slot is formed in said metal plate that isolates a center portion of said metal plate;

wherein said dual-band monopole antenna communicates first radio frequency (RF) signals in a first RF band and second RF signals in a second RF band, wherein said slot is offset a second distance from a perimeter of said metal plate towards a center of said metal plate and wherein said second distance determines a higher-order resonant frequency of said dual-band monopole antenna.

19. A method for forming a dual-band monopole antenna, comprising:

bending a first metal plate including a central opening at a center portion thereof to define first and second portions that form a first angle therebetween;

bending a second metal plate at a center portion thereof to define first and second portions that form said first angle;

using a substrate to locate said second metal plate within said central opening of said first metal plate and to form a slot therebetween, wherein said first portions of said first and second metal plates are substantially co-planar and said second portions of said first and second metal plates are substantially co-planar;

providing a ground plane that is located a first distance from said first metal plate;

wherein said dual-band monopole antenna communicates first radio frequency (RF) signals in a first RF band and second RF signals in a second RF band.

20. The method of claim 19 further comprising providing a feed tab that contacts said first metal plate between said first metal plate and said ground plane and that is located said first distance from said ground plane.

21. The method of claim 19 further comprising adjusting a width of said slot to tune a higher-order resonant frequency of said dual-band monopole antenna.

22. The method of claim 19 wherein said first and second metal plates are rectangular.

23. The method of claim 19 wherein said first metal plates extends a second distance from a center of said first metal plate and said second metal plate extends a third distance from a center of said second metal plate.

24. The method of claim 19 wherein said first angle is equal to one of 60, 90,120, or 180 degrees.

25. The method of claim 19 wherein said first RF signals and said second RF signals are vertical polarized signals.

26. The method of claim 19 wherein said dual-band monopole antenna produces a radiation pattern that is omni-directional in the azimuth plane and vertically polarized in a horizontal plane when communicating said first RF signals and said second RF signals.

27. The method of claim 19 further comprising independently tuning said first RF band and said second RF band.

28. The method of claim 19 wherein said first RF band is an Advanced Mobile Phone System (AMPS) band.

29. The method of claim 19 wherein said first RF band is a Personal Communications Services (PCS) band.

30. The method of claim 19 further comprising:

connecting a first conductor of a feed cable to one of said first portion or said second portion of said first metal plate; and connecting a second conductor of said feed cable to said ground plane.

31. The method of claim 20 further comprising:

connecting a first conductor of a feed cable to said feed tab; and connecting a second conductor of said feed cable to said ground plane.

32. The method of claim 30 further comprising exciting said first metal plate with respect to said ground plane to transmit vertical polarized signals.

33. The method of claim 19 further comprising operating said dual-band monopole antenna in a mobile phone system.

34. The method of claim 19 further comprising containing said dual-band monopole antenna in a housing.

35. The method of claim 34 further comprising mounting said housing behind a rearview mirror of a vehicle.

36. A method for forming a dual-band monopole antenna, comprising:

providing a metal plate that includes first and second portions connecting to form a first angle therebetween;

forming a slot in said metal plate that isolates a center portion of said metal plate;

providing a ground plane that is located a first distance from said metal plate;

wherein said dual-band monopole antenna communicates first radio frequency (RF) signals in a first RF band and second RF signals in a second RF band;

adjusting a second distance that said slot is offset from a perimeter of said metal plate towards a center of said metal plate to tune a higher-order resonant frequency of said dual-band monopole antenna.

* * * * *